US005375420A

United States Patent [19]

Falls et al.

[11] Patent Number: 5,375,420

[45] Date of Patent: Dec. 27, 1994

[54] SEGMENTED CENTERBODY FOR A DOUBLE ANNULAR COMBUSTOR

[75] Inventors: Stephen W. Falls; Hubert S. Roberts, Jr., both of Cincinnati; James N. Cooper, Hamilton; Stephen E. Melton, West Chester, all of Ohio

[73] Assignee: General Electric Company, Cincinnati, Ohio

[21] Appl. No.: 105,772

[22] Filed: Aug. 12, 1993

Related U.S. Application Data

[63] Continuation of Ser. No. 859,760, Mar. 30, 1992, abandoned.

[51] Int. Cl.[5] ..... F02C 7/00

[52] U.S. Cl. ..... 60/747; 60/752

[58] Field of Search ..... 60/39.36, 747, 752, 60/753, 755, 756, 757

[56] References Cited

U.S. PATENT DOCUMENTS

| | | | |
|---|---|---|---|
| 2,548,485 | 4/1951 | Lubbock | 60/753 |
| 2,915,877 | 12/1959 | Darling | 60/753 |
| 3,952,504 | 4/1976 | Sedgwick | 60/753 |
| 4,414,816 | 11/1983 | Craig et al. | 60/757 |
| 4,555,901 | 12/1985 | Wakeman et al. | 60/39.32 |
| 4,567,730 | 2/1986 | Scott | 60/753 |
| 5,079,915 | 1/1992 | Veau | 60/753 |

OTHER PUBLICATIONS

Burrus, D. L., et al. "Energy Efficient Engine: Combustion System Component Technology Development Report", NASA R82AEB401. Nov., 1982. pp. 50, 341, and 397.

*Primary Examiner*—Richard A. Bertsch
*Assistant Examiner*—Timothy S. Thorpe
*Attorney, Agent, or Firm*—Jerome C. Squillaro; David L. Narciso

[57] ABSTRACT

A double annular combustor having concentrically disposed inner and outer annular combustors is provided with inner and outer domes. A centerbody is disposed between the inner and outer domes and is constructed of a plurality of annular segments. Each segment includes an upper wall, a lower wall, an upstream wall and a downstream end. The upper and lower walls include flanges extending therefrom to form cavities, within which are cooling holes. Pins are also provided which extend between the upper and lower walls of the centerbody to augment the cooling and structural connection thereof.

20 Claims, 5 Drawing Sheets

SEGMENTED CENTERBODY FOR A DOUBLE ANNULAR COMBUSTOR

This application is a continuation of U.S. application Ser. No. 07/859,760, filed Mar. 30, 1992, now abandoned.

BACKGROUND OF THE INVENTION

1. Field of the Invention

This invention relates generally to the combustion system of a gas turbine engine and, more particularly, to a double annular combustor having concentrically disposed inner and outer annular combustors with inner and outer domes, and a centerbody disposed between the inner and outer domes constructed of a plurality of annular segments.

2. Description of Related Art

Efforts to reduce emissions in gas turbine engines have brought about the use of staged combustion techniques wherein one burner or set of burners is used for low speed, low temperature conditions such as idle, and another, or additional, burner or burners are used for high temperature operating conditions. One particular configuration of such a concept is that of the double annular combustor wherein the two stages are located concentrically in a single combustor liner. Conventionally, the pilot stage section is located concentrically outside and operates under low temperature and low fuel/air ratio conditions during engine idle operation. The main stage section, which is located concentrically inside, is later fueled and cross-ignited from the pilot stage to operate at the high temperature and relatively high fuel/air ratio conditions. The swirl cups of the respective pilot and main stage sections generally lie in the same radial and circumferential planes, as exemplified by U.S. Pat. No. 4,292,801 to Wilkes, et al. and U.S. Pat. Nos. 4,374,466 and 4,249,373 to Sotheran.

However, as discussed in a development report to the National Aeronautics and Space Administration (NASA) on combustion system component technology for the Energy Efficient Engine ($E^3$) and U.S. Pat. No. 4,194,358 to Stenger, the pilot stage and the main stage may be radially offset (i.e., lie in distinct radial planes). In both the '358 patent and $E^3$ configurations, the effective length of the main stage section is relatively short and the effective length of the pilot stage section is relatively long. This configuration allows for complete or near-complete combustion to reduce the amount of hydrocarbon and carbon monoxide emissions since there is a relatively long residence time in the pilot stage section and a relatively minimal residence time in the main stage section.

Whether the inner and outer combustors are radially aligned or not, and whether the outer annular combustor acts as the pilot stage or main stage, the prior art discloses the use of a centerbody to isolate the pilot and main stages. The intended purpose of such centerbodies is to isolate the pilot stage from the main stage in order to ensure combustion stability of the pilot stage at various operating points and to allow primary dilution air to be directed into the pilot stage reaction zone.

To date, such centerbodies have been a continuous ring fabricated from forged or rolled rings and sheet material. This one-piece design is difficult to manufacture due to tight size and form tolerance requirements for fabrication and assembly. Further, the difference in temperature between the combustor structure and the centerbody generate large hoop stresses and associated forces at the point of attachment. This also occurs as a result of temperature differences in the individual members of the centerbody structure. Another problem with one-piece centerbodies is the effect on the entire piece caused by a local problem. For example, the entire centerbody is depressurized in the event of a local burn-through due to the resulting local leakage. Also, if one area of the centerbody is damaged the entire piece must be repaired or replaced. Accordingly, the present invention proposes an alternative centerbody design which eliminates the problems associated with one-piece centerbodies while maintaining the desirable characteristics thereof.

SUMMARY OF THE INVENTION

A double annular combustor having concentrically disposed inner and outer annular combustors is provided with inner and outer domes. A centerbody is disposed between the inner and outer domes and is constructed of a plurality of annular segments. Each segment includes an upper wall, a lower wall, an upstream wall and a downstream end. The upper and lower walls include flanges extending therefrom to form cavities, within which are cooling holes. Pins are also provided which extend between the upper and lower faces of the centerbody to augment the cooling and structural connection thereof.

BRIEF DESCRIPTION OF THE DRAWINGS

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
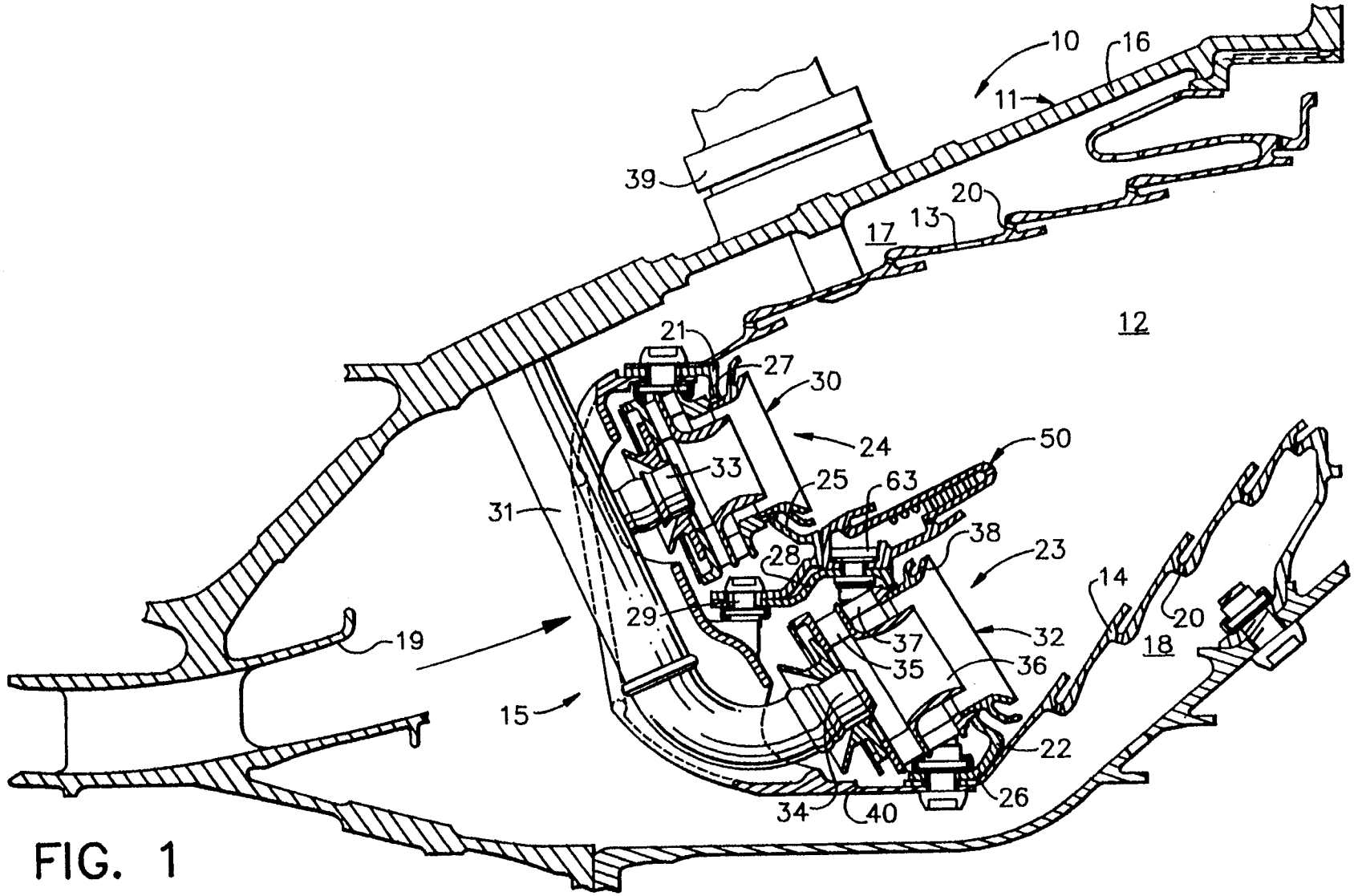
FIG. 1 is a transverse cross-sectional view of a double annular combustor in accordance with a preferred embodiment of the invention.

Referring now to the drawings in detail, wherein identical numerals indicate the same elements throughout the Figures, FIG. 1 depicts a continuous-burning combustion apparatus 10 of the type suitable for use in a gas turbine engine and comprising a hollow body 11 defining a combustion chamber 12 therein. Hollow body 11 is generally annular in form and is comprised of an outer liner 13 and an inner liner 14. At the upstream end of the hollow body 11 is a series of openings 15 for the introduction of air and fuel in a preferred manner as will be described hereinafter.

The hollow body 11 may be enclosed by a suitable shell 16 which, together with liners 13 and 14, defines outer passage 17 and inner passage 18, respectively, which are adapted to deliver in a downstream flow the pressurized air from a suitable source such as a compressor (not shown) and a diffuser 19. The compressed air from diffuser 19 passes principally into annular opening 15 to support combustion and partially to passages 17 and 18 where it is used to cool liners 13 and 14 by way of a plurality of apertures 20 and to cool the turbomachinery further downstream.

Disposed between and interconnecting outer and inner liners 13 and 14 near their upstream ends, are outer and inner domes 21 and 22, respectively, which preferably are separate and distinct dome plates attached to the liners by way of bolts, brazing or the like. Outer and inner dome plates 21 and 22 each have inner portions 25 and 26 and outer portions 27 and 28, respectively. Accordingly, outer dome plate outer portion 27 is connected to outer liner 13 and inner dome plate inner portion 26 is connected to inner liner 14. Outer dome inner portion 25 is connected to inner dome outer portion 28 as described hereinafter.

Dome plates 21 and 22 are arranged in a so-called "double annular" configuration wherein the two form the forward boundaries of separate, radially spaced, annular combustors which act somewhat independently as separate combustors during various staging operations. For purposes of description, these annular combustors will be referred to as the inner annular combustor (main stage section) 23 and outer annular combustor (pilot stage section) 24, and will be more fully described hereinafter.

Located between inner annular combustor 23 and outer annular combustor 24 in the preferred embodiment of FIG. 1 is a centerbody 50 which acts to separate, as well as partially define the common boundary between, inner and outer annular combustors 23 and 24, respectively. Centerbody 50 conducts the flow of air rearwardly to restrain the combustive gases of inner annular combustor 23 from entering outer annular combustor 24 and vice versa. As will be seen in FIG. 2, centerbody 50 preferably is divided into a plurality of segments 51 having equal circumferential length. It should be noted that each segment 51 of centerbody 50 preferably is connected to inner and outer dome plate 22 and 21 and has an upper wall 52, a lower wall 53, an upstream wall 54, and a downstream end 55 with an interior chamber defined therein. Upper wall 52 and lower wall 53 each include flanges 56 and 57 extending therefrom, whereby upper and lower cavities 58 and 59 are formed. Within upper and lower cavities 58 and 59 are cooling holes 60 and 61, respectively. In addition, a cooling hole 62 is provided in downstream end 55.

As seen in FIG. 1, each segment 51 of centerbody 50 preferably is connected to inner dome outer portion 28 by means of bolts 63 or other fastening means. Bolts 63 extend through holes 64 in inner dome outer portion 28 and radial portion 66 of openings 65 in lower wall 53. Additional holes 67 are provided in inner dome outer portion 28 to allow cooling air flow through openings 65 in lower wall 53 for the interior 68 of centerbody 50. This air flow then circulates through cooling holes 60, 61 and 62 to provide cooling to the inner and outer surfaces of centerbody 50.

Figure 2:
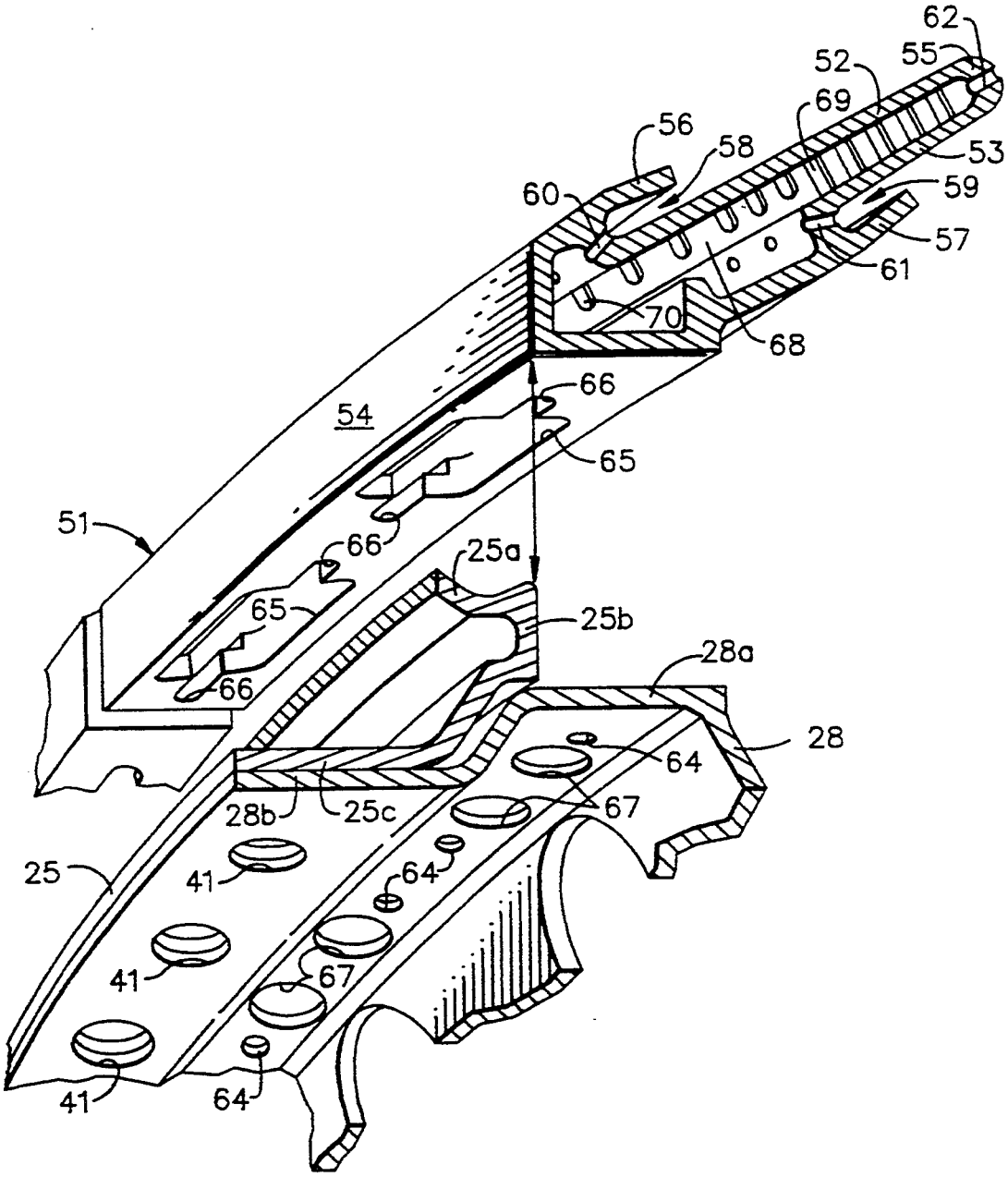
FIG. 2 is a partial perspective view of the centerbody and inner and outer domes of FIG. 1, where the centerbody has been detached from the inner dome to show the lower walls thereof.

With respect to the fit between centerbody 50 and outer and inner dome plates 21 and 22, it will be noted that outer dome plate inner portion 25 has a first section **25*a* that is brazed to carburetor 30 at one end and extends substantially downstream to a second section 25*b* which extends substantially radially inward, and thereafter to a third section 25*c* which extends substantially upstream. Second section 25*b* of outer dome plate inner portion 25 lies adjacent to upstream face 54 of centerbody 50. Inner dome plate outer portion 28 includes a first section 28*a* which is brazed to carburetor 32 at one end and extends substantially upstream adjacent to a portion of lower wall 53 of centerbody 50. Thereafter, a second section 28*b* of inner dome plate outer portion 28 lies substantially parallel to third section 25*c* of outer dome plate inner portion 25 and is preferably connected thereto by means of a bolt 29, thereby attaching outer dome plate inner portion 25 and inner dome plate outer portion 28. As best seen in FIG. 2, holes 41 are provided in third section 25*c* and second section 28*b* which are aligned to receive bolts 29**.

In order to augment the cooling of centerbody 50, as well as the structure thereof, it is preferred that columns or pins 69 extend between the interior surfaces of upper wall 52 and lower wall 53. This is particularly beneficial near downstream end 55 of centerbody 50 as depicted in FIGS. 1 and 2. Further, ribs or bumps 70 may be provided from the interior surface of upper wall 52 where the space between upper wall 52 and lower wall 53 is greater, as, for example, upstream of lower cavity 59. Both the pins 69 and the ribs/bumps 70 help to conduct the high temperature experienced by upper wall 52 away therefrom. This occurs principally during start-up or when only the pilot stage (outer annular combustor 24) is fired. Of course, high temperature experienced by lower wall 53 of centerbody 50 during main stage (inner annular combustor 23) operation may be conducted to upper wall 52 in the same manner to balance the effects thereof. An important feature of using a segmented centerbody like that of the present invention is the ability to make such segments 51 from a single investment casting. This allows improvements in the internal heat transfer surfaces which in turn reduces the demand for cooling air. Since centerbody 50 is not a continuous ring, no hoop stresses and associated forces are generated from thermal gradients. Rather, since centerbody 50 is made up of individual segments, failure of one segment does not affect cooling of the other segments, thereby providing centerbody 50 greater tolerance to damage. Maintenance and repair is enhanced since only damaged segments need to be replaced at overhaul.

It is preferred that centerbody segments 51 be made of ceramic, although a metallic centerbody with a thermal barrier coating may also be utilized. Ceramic segments allow the metal dome structures to expand and contract without structural damage to the centerbody, as the thermal expansion of ceramic and metals is significantly different. This ceramic construction will also allow centerbody 50 to operate in a much hotter environment without cooling air.

Disposed in outer annular combustor 24 is a plurality of circumferentially spaced carburetor devices 30 with their axes being coincident with that of outer annular combustor 24 and aligned substantially with outer liner 13 to present an annular combustor profile which is substantially straight. It should be understood that carburetor device 30 can be of any of various designs which acts to mix or carburet the fuel and air for introduction into combustion chamber 12. One design might be that shown and described in U.S. Pat. No. 4,070,826, entitled "Low Pressure Fuel Injection System," by Stenger et al, and assigned to the assignee of the present invention. In general, carburetor device 30 receives fuel from a fuel tube 31 through fuel nozzle 33 and air from annular opening 15, with the fuel being atomized by the flow of air to present an atomized mist of fuel to combustion chamber 12.

In a manner similar to outer annular combustor 24, inner annular combustor 23 includes a plurality of circumferentially spaced carburetor devices 32 whose axes are aligned substantially parallel to the axis of carburetor device 30. Carburetor devices 32, together with inner dome plate 22, inner liner 14 and centerbody 50 define inner annular combustor 23 which may be operated substantially independently from outer annular combustor 24 as mentioned hereinbefore. Once again, the specific type and structure of carburetor device 32 is not important to the present invention, but should preferably be optimized for efficiency and low emissions performance. For description purposes only, and except for considerably higher airflow capacity, carburetor device 32 is identical to carburetor device 30 and includes a fuel nozzle 34 connected to fuel tube 31 for introducing fuel which is atomized by high pressure or introduced in a liquid state at a low pressure. A primary swirler 35 receives air to interact with the fuel and swirl it into venturi 36. A secondary swirler 37 then acts to present a swirl of air in the opposite direction so as to interact with the fuel/air mixture to further atomize the mixture and cause it to flow into combustion chamber 12. A flared splashplate 38, which preferably is integral with the swirl cup, is employed at the downstream end of carburetor device 32 so as to prevent excessive dispersion of the fuel/air mixture. This integral splashplate/swirl cup 38 is the subject of a separate patent application (Ser. No. 07/860,332) by the assignee and is filed concurrently herewith; the subject matter of which is hereby incorporated by reference. An igniter 39 is installed in outer liner 13 so as to provide ignition capability to outer annular combustor 24.

A cowl 40 is provided in order to stabilize the dome structure, as well as to protect carburetor devices 30 and 32. Cowl 40 is designed so that fuel tube 31 may fit snuggly adjacent thereto. Cowl 40 is not a part of the presently claimed invention, but is the subject of a separate patent application (Ser. No. 07/860,398) by the assignee and is filed concurrently herewith. The subject matter of that application is hereby incorporated by reference.

Considering now the operation of the above-described double annular combustor, outer annular combustor 24 and inner annular combustor 23 may be used individually or in combination to provide the desired combustion condition. Preferably, outer annular combustor 24 is used by itself for starting and low speed conditions and will be referred to as the pilot stage. The inner annular combustor 23 is used at higher speed, higher temperature conditions and will be referred to as the main stage combustor. Upon starting the engine and for idle condition operation, carburetor devices 30 are fueled by way of fuel tubes 31, and pilot stage 24 is ignited by way of igniter 39. The air from diffuser 19 will flow as shown by the arrows, both through active carburetor devices 30 and through inactive carburetor devices 32. During these idle conditions, wherein both the temperatures and airflow are relatively low, pilot stage 24 operates over a relatively narrow fuel/air ratio band and outer liner 13, which is in the direct axial line of carburetor devices 30, will see only narrow excursions in relatively cool temperature levels. This will allow the cooling flow distribution in apertures 20 to be maintained at a minimum. Further, because outer annular combustor 24 and inner annular combustor 23 lie in distinct axial planes, pilot stage 24 is relatively long as compared with main stage 23 and the residence time will preferably be relatively long to thereby minimize the amount of hydrocarbon and carbon monoxide emissions.

As the engine speed increases, fuel is introduced by fuel tube 31 into carburetor devices 32 through fuel nozzles 34 so as to activate main stage 23. During such higher speed operation, pilot stage 24 remains in operation but main stage 23 consumes the majority of the fuel and the air. It will be recognized that main stage 23 is axially short in length when compared with pilot stage 24 due to the axial offset therebetween, whereby the residence time will be relatively short to reduce the NOx emissions.

It will be understood that the present invention has been described in terms of particular embodiments, but may take on any number of forms while remaining within the scope and intent of the invention. For example, it will be recognized that the present invention would be applicable to any double annular combustor, whether the inner and outer annular combustors lie in distinct radial and circumferential planes or not. Also, while FIG. 1 shows centerbody 50 to be connected to inner dome plate 22, it could just as well be connected to outer dome plate 21.

Figure 3:
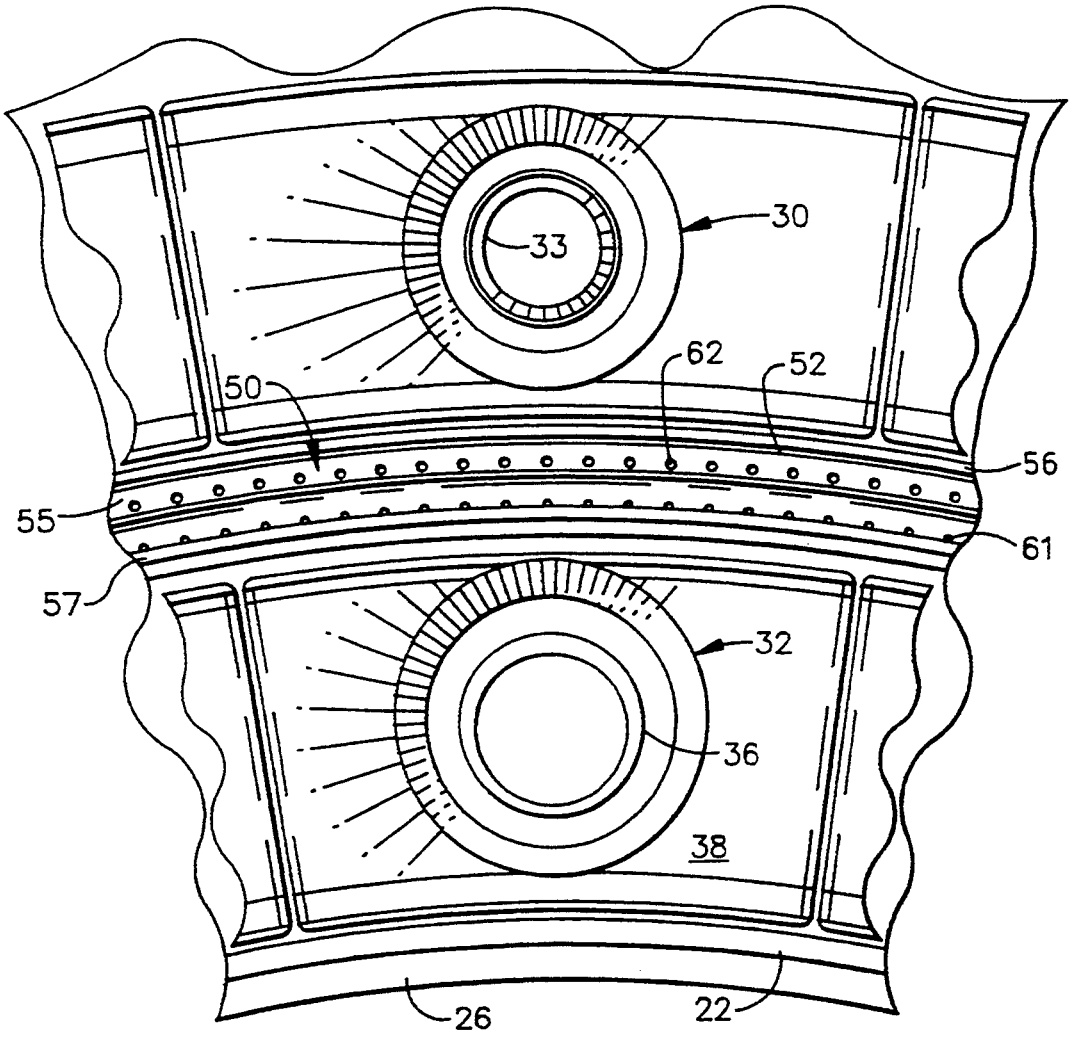
FIG. 3 is a partial axial view of the double annular combustor of FIG. 1 seen along 3—3 thereof.
Figure 4:
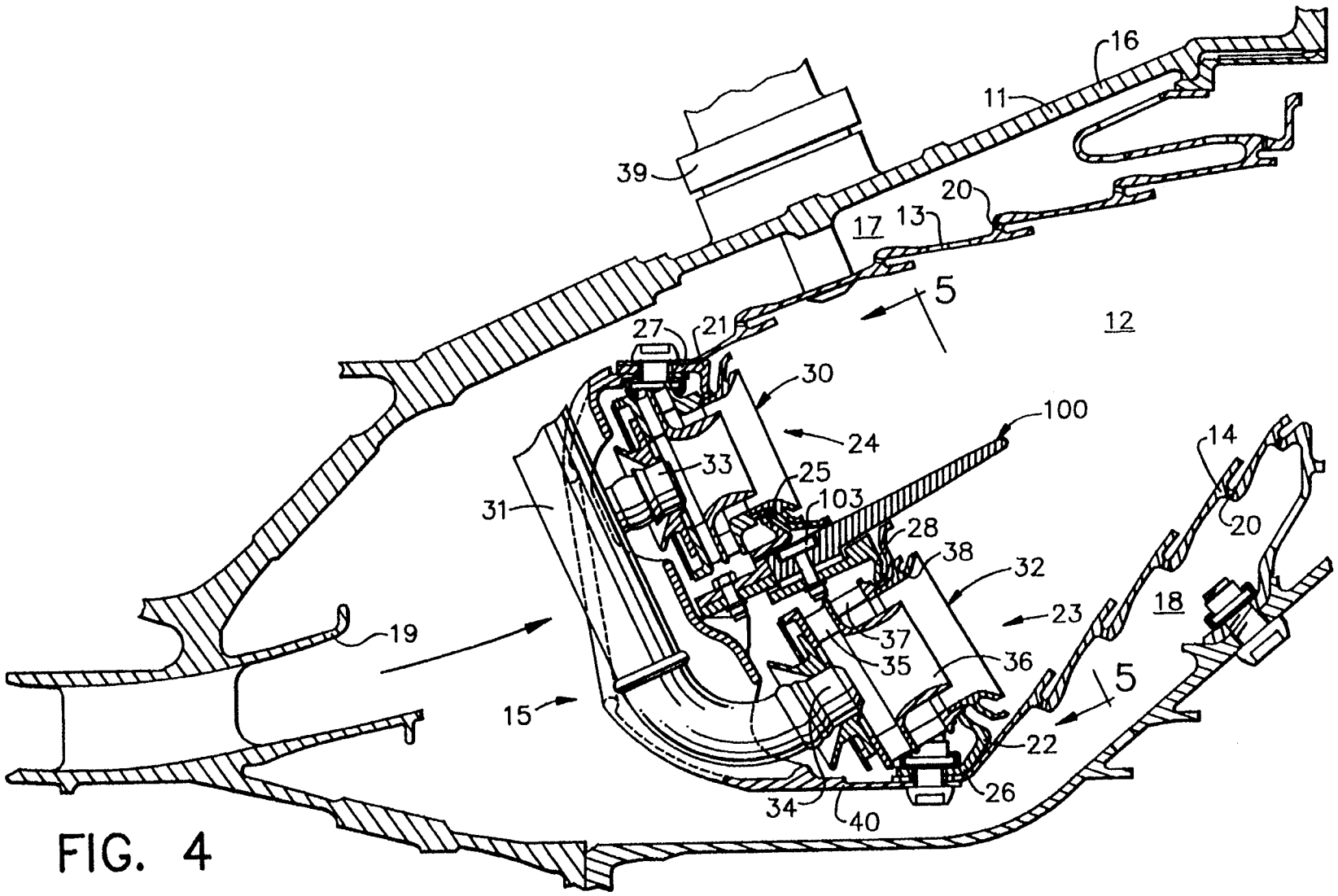
FIG. 4 is a transverse cross-sectional view of a double annular combustor having a centerbody of an alternate design.
Figure 5:
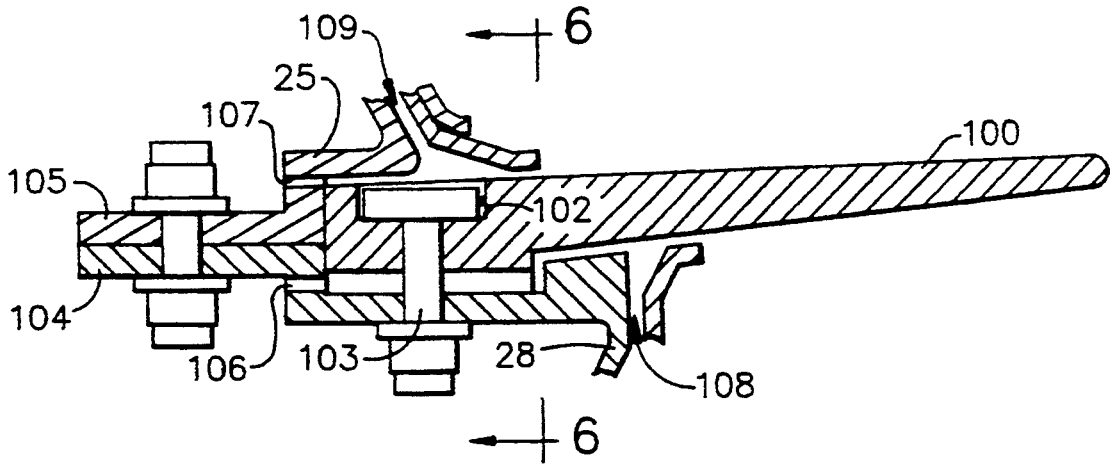
FIG. 5 is a magnified transverse cross-sectional view of the centerbody in FIG. 4.
Figure 6:
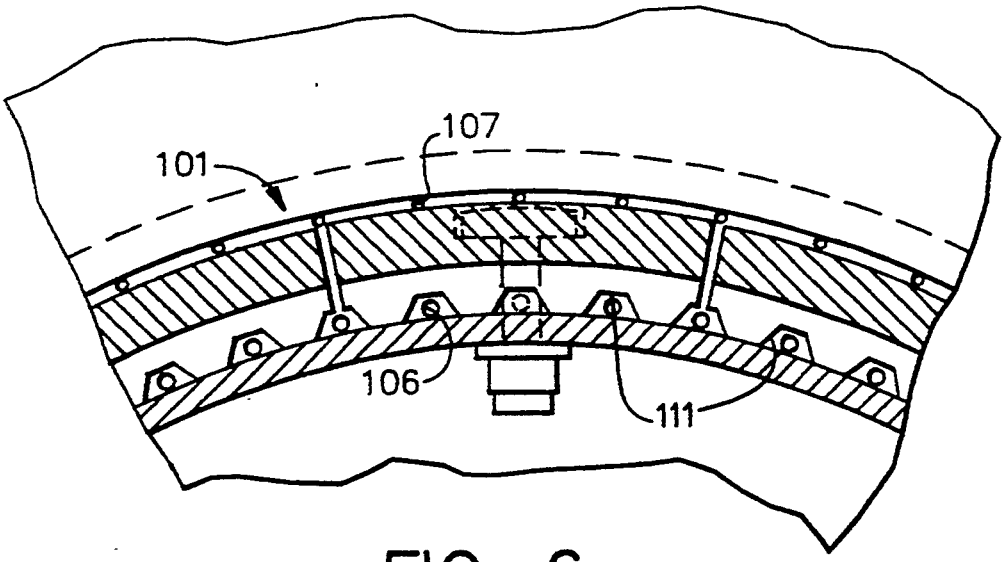
FIG. 6 is a partial axial view of the centerbody in FIG. 5 seen along 6—6 thereof.

A second embodiment of the present invention is depicted in FIGS. 4–6, wherein identical numerals are used for like elements of FIGS. 1–3. In particular, an alternative centerbody arrangement 100 is shown which also is made up of a plurality of segments 101. It will be noted that centerbody 100 is essentially solid, but for a hole 102 therethrough with a spot face at the top of centerbody 100 to recess a bolt 103 therein.

As distinguished from the preferred embodiment, centerbody 100 is secured to a separate flange 104, which is attached to carburetor 32 at one end upstream of inner dome plate outer portion 28 and extends upstream generally parallel and adjacent to the lower surface of centerbody 100. Further, an upper flange 105 is provided which is attached at one end to carburetor device 30 upstream of outer dome plate inner portion 25. Flanges 104 and 105 meet adjacent to the upstream surface of centerbody 100 and extend upstream therefrom where they are connected to support the overall dome structure. In this design, outer dome plate 21 is separated from overall centerbody segments 101 by a thin space, which is used for cooling and to prevent any contact stresses from building up therebetween.

As best seen in FIG. 5, holes 106 and 107 are provided in flanges 104 and 105, respectively, which allows cooling air to flow along the upper surface and lower surface of centerbody 100. Additional air is provided thereto by passages 108 and 109, which channel air previously used to cool splash plate 38 on main stage 23.

Truncated "V"-shaped slots are formed along the lower surface of centerbody 100, slots 111 along the lower surface being shown in FIG. 6. These slots are utilized to cool the centerbody-to-dome plate interfaces, and are particularly useful when centerbody 100 is made of ceramic. Slots 111 also serve to reduce the contact area between centerbody 100 and inner dome 22, thereby restricting heat flow therebetween.

Having thus described the invention, what is claimed is novel and desired to be secured by Letters Patent of the United States is:

1. A double annular combustor having concentrically disposed inner and outer annular combustors, comprising:

a) an inner dome including an inner portion and an outer portion;

b) an outer dome including an inner portion and outer portion, wherein said outer dome inner portion is connected to said inner dome outer portion; and c) a substantially annular centerbody disposed between said inner dome and said outer dome, said centerbody further comprising a plurality of structurally independent arcuate segments, wherein said centerbody is connected to either said outer dome inner portion or said inner dome outer portion.

2. The double annular combustor of claim 1, wherein said centerbody includes an upper wall, a lower wall, an upstream wall and a downstream end to form an interior chamber.

3. The double annular combustor of claim 2, wherein said lower wall of said centerbody is connected to said inner dome outer portion.

4. The double annular combustor of claim 2, wherein said upper wall of said centerbody is connected to said outer dome inner portion.

5. The double annular combustor of claim 2, wherein said lower wall includes a plurality of openings for receipt of cooling flow by the interior chamber of said centerbody.

6. The double annular combustor of claim 2, wherein said downstream end includes at least one cooling hole.

7. The double annular combustor of claim 1, wherein said inner annular combustor is radially offset downstream of said outer annular combustor.

8. The double annular combustor of claim 7, wherein said outer dome inner portion includes a first section extending substantially downstream toward said centerbody, a second section extending substantially radially inward, and a third section extending substantially upstream of said centerbody, said second section lying adjacent to said centerbody upstream wall and said third section being attached to said inner dome outer portion.

9. The double annular combustor of claim 8, wherein said second section of said outer dome inner portion is connected to said upstream wall of said centerbody.

10. The double annular combustor of claim 9, wherein said inner dome outer portion includes a first section lying adjacent and connected to said centerbody lower wall, and a second section lying substantially parallel and connected to said third section of said outer dome inner portion.

11. The double annular combustor of claim 2, wherein said centerbody upper and lower walls include flanges extending therefrom to form upper and lower cavities, said flanges each including at least one cooling hole.

12. The double annular combustor of claim 2, wherein at least one pin extends from said centerbody upper wall to said lower wall.

13. The double annular combustor of claim 2, said centerbody upper wall including ribs extending from the interior surface thereof.

14. The double annular combustor of claim 2, said centerbody including means for augmenting the cooling and structural connection of said centerbody upper and lower walls.

15. The double annular combustor of claim 1, wherein said arcuate segments are of substantially equal circumferential length.

16. The double annular combustor of claim 1, wherein said centerbody is made of ceramic.

17. The double annular combustor of claim 1 further including a first flange extending from said inner dome outer portion and a second flange extending from said outer dome inner portion, wherein said centerbody is connected to said first flange.

18. The double annular combustor of claim 17, wherein said centerbody includes an upper face, a lower face, an upstream face, and a downstream end, and said first and second flanges are connected upstream of said centerbody upstream face.

19. The double annular combustor of claim 18, wherein V-shaped slots are provided adjacent the upper and lower faces of said centerbody for cooling the interfaces between said centerbody and said inner and outer domes.

* * * * *